US008573140B2

(12) United States Patent
Miyashita

(10) Patent No.: US 8,573,140 B2
(45) Date of Patent: Nov. 5, 2013

(54) SAFETY BOX

(75) Inventor: Sugaya Miyashita, Tokyo (JP)

(73) Assignee: DT Engineering Co., Ltd., Tokyo (JP)

( * ) Notice: Subject to any disclaimer, the term of this patent is extended or adjusted under 35 U.S.C. 154(b) by 0 days.

(21) Appl. No.: 13/370,660

(22) Filed: Feb. 10, 2012

(65) Prior Publication Data

US 2012/0222589 A1 Sep. 6, 2012

(30) Foreign Application Priority Data

Mar. 2, 2011 (JP) ..... 2011-044602

(51) Int. Cl.
*E05G 1/06* (2006.01)

(52) U.S. Cl.
USPC ..... 109/51; 109/53; 109/59 R; 70/63; 70/278.1

(58) Field of Classification Search
USPC ..... 109/38, 40, 43, 44, 53, 59 R, 50–52; 70/63, 277, 278.1
See application file for complete search history.

(56) References Cited

U.S. PATENT DOCUMENTS

| | | | | |
|---|---|---|---|---|
| 4,438,606 | A * | 3/1984 | Chardon et al. | 109/50 |
| 5,199,361 | A * | 4/1993 | Robinson | 109/51 |
| 5,778,805 | A * | 7/1998 | Green | 109/51 |
| 5,936,544 | A * | 8/1999 | Gonzales et al. | 109/53 |
| 6,040,771 | A * | 3/2000 | Kim | 70/277 |
| 6,113,268 | A * | 9/2000 | Thompson | 109/50 |
| 6,318,134 | B1 * | 11/2001 | Mossberg et al. | 70/278.1 |
| 7,006,876 | B2 * | 2/2006 | Ross | 700/12 |
| 7,116,224 | B2 * | 10/2006 | Mickler | 70/63 |
| 7,961,914 | B1 * | 6/2011 | Smith | 70/277 |
| 8,201,426 | B2 * | 6/2012 | Heim et al. | 70/63 |
| 2009/0108988 | A1 * | 4/2009 | Cleveland et al. | 70/278.1 |
| 2011/0041573 | A1 * | 2/2011 | Giles | 70/278.1 |

FOREIGN PATENT DOCUMENTS

| | | |
|---|---|---|
| JP | 8-10022 | 1/1996 |
| JP | 2004-129706 | 4/2004 |

* cited by examiner

*Primary Examiner* — Christopher Boswell
(74) *Attorney, Agent, or Firm* — Nixon & Vanderhye P.C.

(57) ABSTRACT

A safety box comprises a main body housing provided with a storage portion and a weight portion. The storage portion has a storage portion housing which partly forms the main body housing, a storage portion room for storing objects, a storage portion lid, an electric lock for keeping the lid locked, and a controller for controlling locking and unlocking of the electric lock in response to input of predetermined information. The weight portion has a weight portion housing which partly forms the main body housing, a weight potion room for storing weight substance, and openings for the substance to be filled in and released from the room.

9 Claims, 4 Drawing Sheets

SAFETY BOX

This application claims priority to JP 2011-044602 filed 2 Mar. 2011, the entire contents of each of which are hereby incorporated by reference.

FIELD OF THE INVENTION

The present invention relates to a safety box for keeping valuables in outdoor leisure activities, and more particularly, to a portable safety box which is easy to carry with when not in use.

BACKGROUND OF THE INVENTION

Conventionally, there have been troubles finding out how to keep valuables such as wallets, cell-phones, IDs during outdoor leisure activities. For example, there is no choice but to climb a mountain or swim in sea with leaving valuables at a base point when it is trouble to carry with the valuables. In such a case, members take turns in watching their valuables, diminishing pleasant time with all members. Japanese published patent application No. H08-10022 discloses a waterproof carrying pouch for valuables, but some troubles such as blocking movements are inevitable despite its compactness as long as it is used with being carried on you.

To that end, Japanese published patent application No. 2004-129706 discloses a portable storage body for storing valuables and heavy goods having an opening part with a lid. The storage body stores sea water, sand, and stones as heavy goods when used with a view to preventing theft by making the storage body hard to be carried away.

However, the portable storage body of Japanese published patent application No. 2004-129706 has some problems: necessity of a key being kept with a user at least because the lid and the storage body are connected and locked by means of a commonly-used manual key, possibility of being unable to unlock due to loss of the key, and lack of countermeasure against carrying away in spite of the body's heavy weight.

In view of the above-explained problems in related art, it is an objective of the present invention to provide a safety box which is easy to carry when not in use. In addition, considerable weight can be added to the safety box when used, an operation of locking/unlocking is easy without any possibility of loss of the key, and a countermeasure against carrying away is provided in the safety box.

SUMMARY OF THE INVENTION

In an attempt to accomplish the above objective, the present invention provides the following constitution. A safety box according to the present invention has a main body housing provided with a weight portion and a storage portion. The weight portion comprises a weight portion housing partly forming the main body housing, a weight potion room framed by the weight portion housing for storing weight substance, and one or more openings for filling/releasing the weight substance into/from the weight portion room. The storage portion comprises a storage portion housing partially forming the main body housing, a storage portion room framed by the storage portion housing for storing objects, a storage portion lid for closing the storage portion room, an electric lock for keeping the storage portion lid locked, and a controller for controlling locking/unlocking of the electric lock in response to input of predetermined information.

One or more sensors for detecting movement of the main body housing and one or more sonic/visual alarming devices which go off in response to detection by the sensors may be provided in the main body housing in the safety box.

A motion sensor for detecting a person approaching within a predetermined distance from the main body housing and the sonic/visual alarming devices which go off in response to detection by the motion sensor may be provided in the main body housing in the safety box.

The controller may be capable of wireless communication with one or more remote devices disposed away from the main body housing and may send a signal to the remote devices in response to actuation of the alarming devices in the safety box.

The controller may be capable of controlling locking/unlocking of the electric lock in response to receiving a predetermined signal from the remote devices in the safety box.

A transmitter which starts transmission in response to actuation of the alarming devices may be provided in the main body housing in the safety box.

The storage portion housing and the weight portion housing may be undetachable and integrally form the main body housing in the safety box.

In the safety box, the storage portion housing and the weight portion housing may be detachable. The storage portion lid may be disposed on a connecting face of the storage portion housing in a condition of storage portion housing and weight portion housing being connected with each other. The electric lock may keep the storage portion housing and the weight portion housing connected and simultaneously keep the storage portion lid locked.

The present invention is provided to achieve a portable safety box suitable for use in outdoor activities. In the safety box according to the present invention, weight sufficient to cause difficulty in carrying can be added by filling the weight portion room of the main body housing with adequate weight substance. For example, water, sea water, sand, and stones are filled as weight substance when used during sea bathing. In the storage portion room, valuables such as money and cell phones are stored. The safety box is carried easily when in not use by releasing weight substance to reduce its weight. In particular, provision of the electric lock for keeping the storage portion lid locked and the controller for controlling locking/unlocking of the electric lock by means of input of predetermined information leads to doing away with a key to be carried with or to get lost.

Provision of the sensor for detecting movement of the main body housing and the sonic/visual alarming devices which go off in response to detection by the vibration sensor prevents a grabber who tries to take away the safety box by sounding the alarm.

Provision of the motion sensor for detecting a person approaching within a predetermined distance from the main body housing and the sonic/visual alarming devices which go off in response to detection by the motion sensor prevents a grabber who tries to take away the safety box by sounding the alarm.

The remote device away from the main body housing is worn by a user. The device is capable of wireless communication with the controller. The controller signals to the remote device in response to actuation of the alarming devices and the user is immediately informed of something happened on the safety box.

An easier locking/unlocking operation for a user than manual operation is performed because the controller is capable of controlling locking/unlocking of the electric lock in response to receiving a predetermined signal from the remote device.

In a case that the storage portion housing and the weight portion housing are undetachable and integrally form the main body housing, its structure is simple and the manufacturing cost is low.

In a case that the storage portion housing and the weight portion housing are detachable, weight substance can be easily filled into and released from the weight portion with the both housings being detached. In addition, disposing the storage portion lid on the connecting face of storage portion housing with the both housings being connected may serve to prevent the lid from being broken because it is not exposed to and cannot be seen from the outer surface. Furthermore, the use of the electric lock for keeping the both housings connected brings about the same advantage as an electric lock without actually being disposed on the storage portion lid itself. In other words, the electric lock may serve to keep the both housings connected and to keep the storage portion lid locked.

BRIEF DESCRIPTION OF THE DRAWINGS

FIG. 3(*b*) illustrates a perspective view in a detached condition.

FIG. 4(*b*) illustrates a perspective view in a detached condition.

DETAILED DESCRIPTION OF THE PREFERRED EMBODIMENTS

Figure 1:
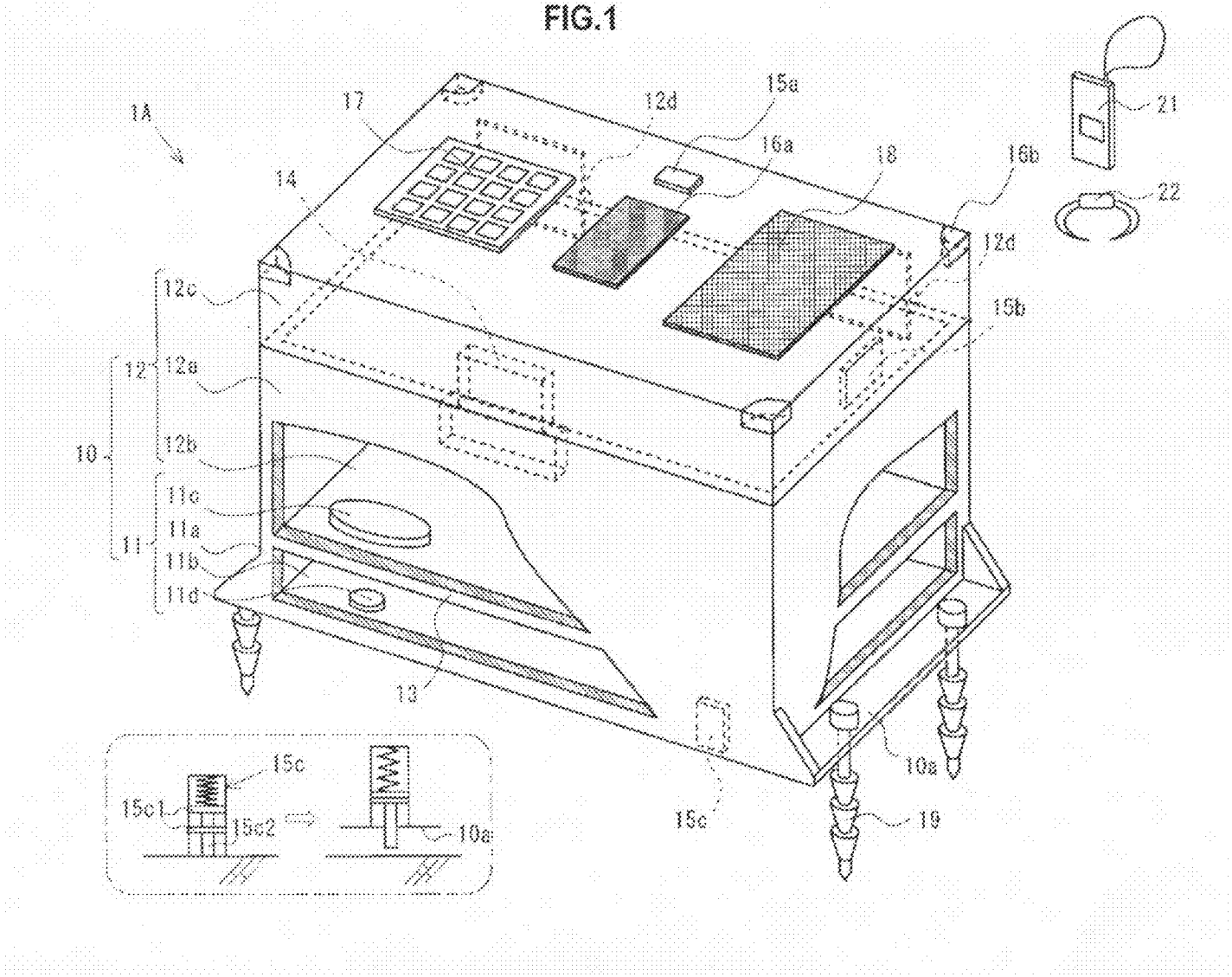
FIG. 1 illustrates a perspective view with a partial cutaway of a safety box in accordance with a first embodiment of the present invention.

Preferred embodiments of the present invention are described hereinafter with reference to the accompanying drawings. FIG. 1 illustrates a perspective view with a partial cutaway of a safety box 1A in accordance with a first embodiment of the present invention. The safety box 1A has the main body housing 10 in shape of a near rectangular cuboid. The main body housing 10 has such strength and durability that it is hard to damage or break as a housing of safety box. Meanwhile, the main body housing 10 itself does not need required weight as a safety box, instead, lightweight is preferable so as to be easily carried when in not use. This is because the weight of safety box as itself is obtained by filling the weight portion 11 with weight substance.

(This applies to other embodiments to be hereinafter described.)

In the embodiment, the weight portion 11 and the storage portion 12 are integrally provided on the lower part and the upper part, respectively, in the main body housing 10. They are comparted with a wall 13. A bottom plate 10*a* of main body housing 10 protrudes in a horizontal direction. Difficulty in moving the safety box is boosted by putting stakes 19 through the protruded plate to the sand beach or the ground. (This applies to other embodiments to be hereinafter described.)

The weight portion 11 comprises the weight portion housing 11*a* partly forming the main body housing 10, the weight portion room 11*b* whose four side walls are framed by the weight portion housing 11*a*, an inlet 11*c*, and an outlet 11*d*. The weight portion room 11*b* is for storing weight substance. For example, water, sea water, sand, or stone, which are easily available outdoors, are used as weight substance. In the example of FIG. 1, an opening as inlet 11*c* is provided on the wall 13 forming the top face of weight portion room 11*b*, and another opening as outlet 11*d* is provided on the bottom plate 10*a* forming the bottom face of weight portion room 11*b*. The position, shape, and size of inlet 11*c* and outlet 11*d* on each face are not limited to the illustrated example. It is preferable that the weight portion housing 11*a*, the wall 13, the inlet 11*c*, and the outlet 11*d* have waterproof and airtight properties.

The storage portion 12 comprises the storage portion housing 12*a* partially forming the main body housing 10, the storage portion room 12*b* framed by the storage portion housing 12*a*, and the storage portion lid 12*c* for closing the storage portion room 12*b*. Objects to be stored are, for example, valuables such as money and cell phones. The storage portion lid 12*c* is opened and closed by using a hinge 12*d*. Component parts of the electric lock 14 are disposed in the storage portion lid 12*c* and the storage portion housing 12*a*, respectively. The electric lock 14 is locked and unlocked electrically, not manually. The electric lock 14 may be any of publicly-known type such as motorized, solenoidal, or electromagnetic type.

The controller 17 transmits to the electric lock 14 a signal to lock/unlock it (illustration of wiring is not shown). Inputting predetermined information via an operation part of controller 17 locks and unlocks the electric lock 14. In the illustrated example, the controller 17 has a numerical keypad as an operation part for inputting predetermined passwords to lock/unlock. Password type is preferable in that it is low in cost though biometric authentication may be used.

The controller 17, in addition to controlling the electric lock 14, may has further function to configure and control various sensors and alarming devices to be hereinafter described. To this end, the controller has a built-in programmable controller capable of configuring a simple program. The controller 17 may have waterproof property for use in outdoor activities, for example, a touch panel or waterproof cover may be provided. When a larger screen, such as touch panel, is provided, photos and moving images can be displayed on the screen. Further, music and audio output may be available with an audio output device (which may double as alarm to be hereinafter described).

In order to fill the weight portion 11 with weight substance, the storage portion lid 12*c* is opened and the inlet 11*c* on the bottom face of storage portion room 12*b* is opened. For example, a hose may be used for filling water and a tool such as a funnel may be used for filling sand. In order to release weight substance, the main body housing 10 is placed sideways and the outlet 11*d* on the bottom face of main body is opened. It is preferable that the inlet 11*c* and the outlet 11*d* are provided at a point where they cannot be confirmed visually and hard to be touched so as to prevent a prank to open the outlet and release weight substance.

The vibration sensor 15*b* for detecting vibration caused by movement of the main body housing 10 and the sonic/visual alarming devices which go off in response to detection by the vibration sensor 15*b* may be provided on the main body housing 10. The vibration sensor 15*b* may be disposed on an appropriate position. The alarming devices include, e.g., an alarm 16*a* which emits sound and an alarm lamp 16*b* which emits blinking light. Sensitivity of vibration sensor 15*b* and alarming degree, type, and duration of alarming devices may be configured with the operation part of controller 17.

The motion sensor 15*a* for detecting a person approaching within a predetermined distance from the main body housing 10 and the sonic/visual alarming devices which go off in response to detection by the motion sensor 15*a* may be provided on the main body housing 10. The motion sensor 15*a* may be disposed on an appropriate position. The above-described alarm 16*a* and alarm lamp 16*b* double as alarming devices. Sensitivity of vibration sensor 15*a* and alarming degree, type, and duration of alarming devices may be configured with the operation part of controller 17.

As another embodiment of the sensor, a limit switch 15*c* may be disposed on the bottom plate 10*a* of main body housing. The operation system of limit switch 15*c* is schematically illustrated in the lower left of FIG. 1. When the bottom plate 10*a* of main body housing is in contact with the ground, a contact 15*c*1 is open due to a detection rod 15*c*2 pressing a spring. When the main body housing is moved up and the bottom plate 10*a* is moved away from the ground, the contact 15*c*1 is closed due to the detection rod 15*c*2 being pressed by the spring. The limit switch 15 is linked to the controller 17 and the controller detects open/close of the contact 15*c*1. The controller 17 activates the alarming devices in response to a signal from the limit switch 15*c*. As the limit switch 15*c*, various types of well-known limit switches may be used without limiting to the illustrated example.

Moreover, not only a limit switch, but also any type of well-known sensor (e.g. optical sensor, ultrasonic sensor, etc.) may be used as long as it is capable of detecting movement of the main body housing.

The remote devices 21, 22 are small and lightweight pendant or bracelet type so as to impose less strain on a user when wearing it and have at least receiving function and simple output function. The simple output function includes a display screen, a LED, and an alarm, for example. The controller 17 is capable of wireless communication with the remote devices 21, 22 away from the main body housing 10. The controller 17 sends a signal to the remote devices 21, 22 in response to actuation of the alarming devices 16*a*, 16*b*. The remote devices 21, 22 perform output on a simple output device in response to receiving the signal, for example, by means of emitting light or sounding an alarm. The user will know occurrence of something unusual.

The remote devices 21, 22 may have a function as remote control key of the controller 17. In this case, the remote devices 21, 22 have functions of transmission and simple input. The simple input function includes, e.g., push buttons. The controller 17 controls to lock/unlock of the electrical lock 14 in response to receiving a predetermined signal from the remote devices 21, 22. The function is used, e.g., when the user locks and moves away from the safety box by using the remote devices 21, 22 after inputting passwords in the operation part of controller 17, or when the user unlocks the safety box by using the remote devices 21, 22 while approaching to the safety box.

In this way the controller 17 and the remote devices 21, 22 are capable of one-way or interactive communication. One-way communication is low in cost. Interactive communication makes various utilization patterns possible.

As another example of utilization of the remote devices 21, 22, when an abnormality occurs in function of each device of the safety box, a signal to notice such abnormality may be sent to the remote devices 21, 22. An error in CPU or a drop in supply voltage of controller 17, etc. are included. In this case, the signal to notice such abnormality may be sent not only automatically from the controller 17 but also from someone around the safety box with manual operation of controller 17.

As a further example of utilization of the remote devices 21, 22, some other signals may be sent from a person wearing remote devices 21, 22 (e.g. signal to call for help).

Although not illustrated here, a transmitter to start transmission of a predetermined signal in response to actuation of alarming devices 16*a*, 16*b* may be provided in the main body housing 10. The constant signal from the transmitter may be received by the remote devices 21, 22 or an external receiver not illustrated here. Such transmitter affords a clue on searching the safety box when it has been carried away.

It is preferable to have a solar cell 18 for the devices among the electric lock 14, controller 17, sensors 15*a*, 15*b*, and alarming devices 16*a*, 16*b*, which require a power supply. A battery, instead of the solar cell 18, may be used as a power supply.

The sensors 15*a*, 15*b* and the alarming devices 16*a*, 16*b* in the embodiment of FIG. 1 may be provided in other embodiments as well without such descriptions.

Figure 2:
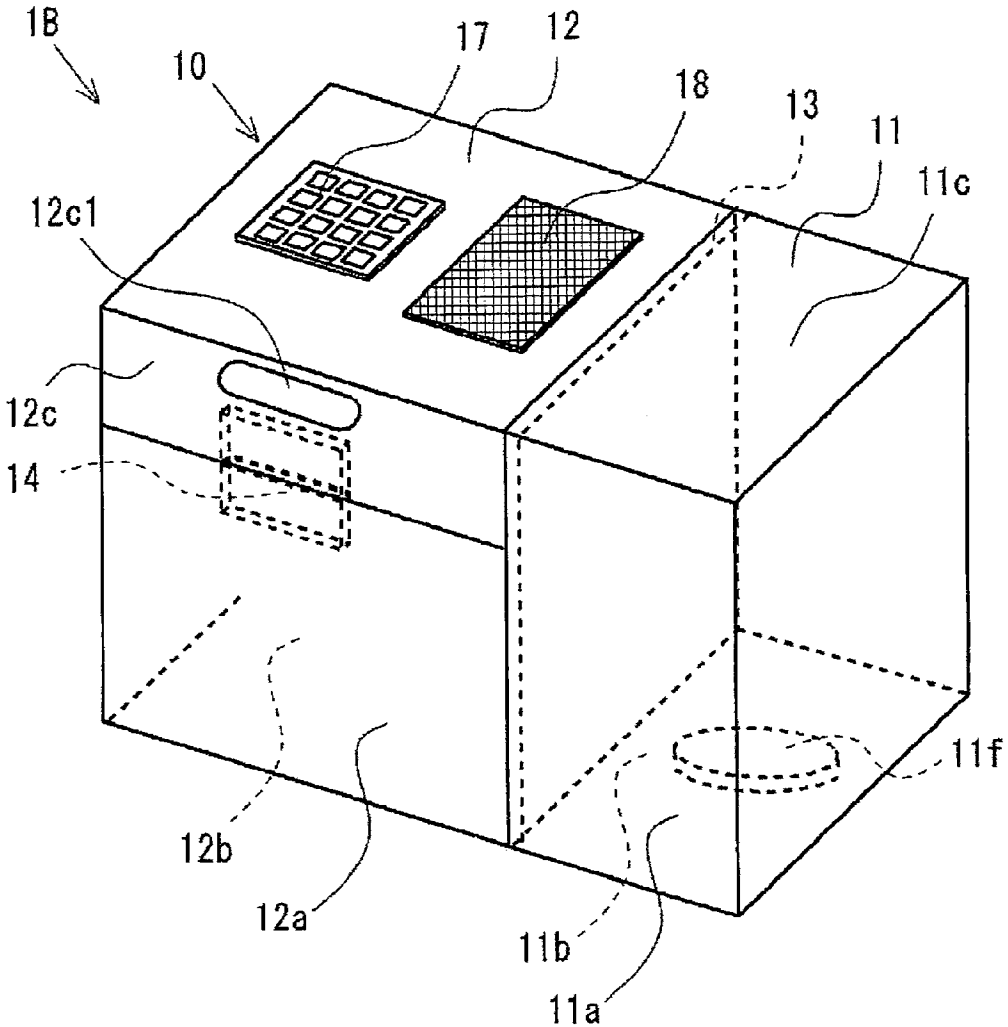
FIG. 2 illustrates a perspective view of a safety box in accordance with a second embodiment of the present invention.

FIG. 2 illustrates a perspective view of a safety box 1B in accordance with a second embodiment of the present invention. The same reference marks as the embodiment in FIG. 1 are used for the same constituent elements.

In the safety box 1B, the weight portion 11 and the storage portion 12 are disposed not vertically but horizontally. An opening for filling/releasing of weight substance into/from the weight potion 11 is an inlet-outlet opening 11*f* on the bottom face. In this case, one opening doubles as inlet and outlet (in other embodiments, an inlet may be used as an outlet). Weight substance is filled/released by turning over the safety box 1B. A recessed hold 12*c*1 for opening/closing the storage potion lid 12*c* of storage portion 12 is provided (an adequate hold may be provided in the storage portion lid 12*c* in other embodiments).

Figure 3A:
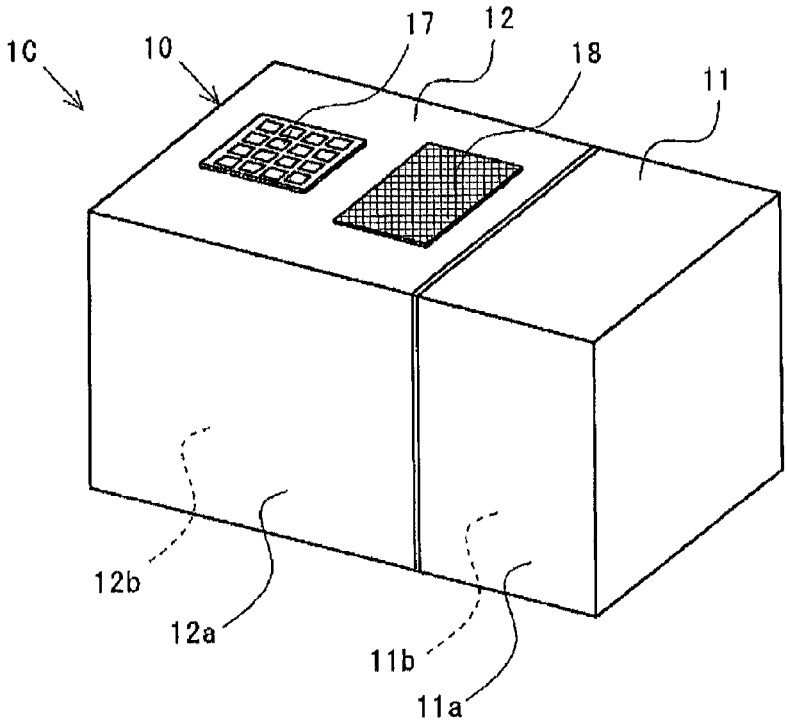
FIG. 3(*a*) illustrates a perspective view of a safety box in a connected condition in accordance with a third embodiment of the present invention.
Figure 3B:
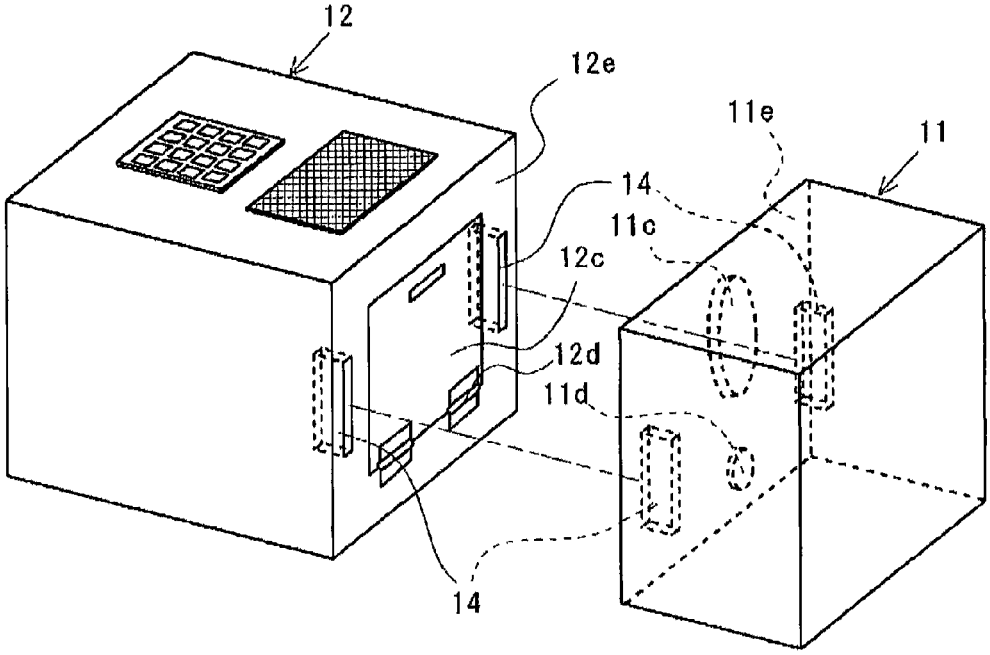

FIG. 3(*a*) illustrates a perspective view of a safety box 1C in a connected condition in accordance with a third embodiment and (b) illustrates a perspective view of the safety box in a detached condition. The same reference marks as the embodiment in FIG. 1 are used for the same constituent elements.

In the safety box 1C, the weight portion 11 and the storage portion 12 are disposed horizontally and detachable.

As illustrated in FIG. 3(*b*), the storage portion lid 12*c* of storage potion 12 is provided on the lateral side of storage portion housing 12*a*. The lateral side is the connecting face 12*e* in a condition of storage portion housing 12*a* and weight portion housing 11*a* being connected. The connecting face 12*e* of storage portion housing 12*a* wholly abuts against the connecting face 11*e* of weight portion housing 11*a* in the connected condition. That is, the storage portion lid 12*c* is not in the least exposed outside without being seen and touched. Tough the storage portion lid 12*c* itself does not have an electric lock for directly locking, a latching means enough to prevent the lid from opening by itself is provided (without illustration).

The electric lock 14 is provided for keeping the storage portion housing 12*a* and the weight portion housing 11*a* connected. Specifically, each component of electric lock 14 is attached to the connecting face 12*e* of storage portion housing 12*a* and the connecting face 11*e* of weight portion housing 11*a*, respectively. The electric lock 14 is provided at two points in the illustrated example. The two locks are linked and their locking/unlocking are controlled by the controller 17. In this way the safety box 1C whose weight portion 11 and storage portion 12 are detachable is the same as the embodiments in FIG. 1 and FIG. 2 in that the electric lock 14 functions to keep the storage portion lid 12*c* locked. In other words, the electric lock 14 serves to keep the storage portion housing 12*a* and the weight portion housing 11*a* connected and simultaneously to keep the storage portion lid 12*c* locked.

The inlet 11*c* for filling weight substance and the outlet 11*d* for releasing weight substance are provided on the connecting face 11*e* of weight portion housing 11*a*. Consequently, both inlet 11*c* and outlet 11*d* cannot be seen and touched from outside under the connected condition.

In order to fill the weight portion 11 with weight substance, the inlet 11*c* on the connecting face 11*e* of weight portion housing 11*a* is opened with weight portion 11 and storage portion 12 being detached. In order to release weight substance, the outlet 11*d* is opened with both portions being detached. One opening may double as inlet 11*c* and outlet 11*d*. In this case, handling is easy and convenient because filling weight substance into the weight portion 11 and storing objects into the storing portion 12 can be preformed separately with both portions being detached.

Figure 4A:
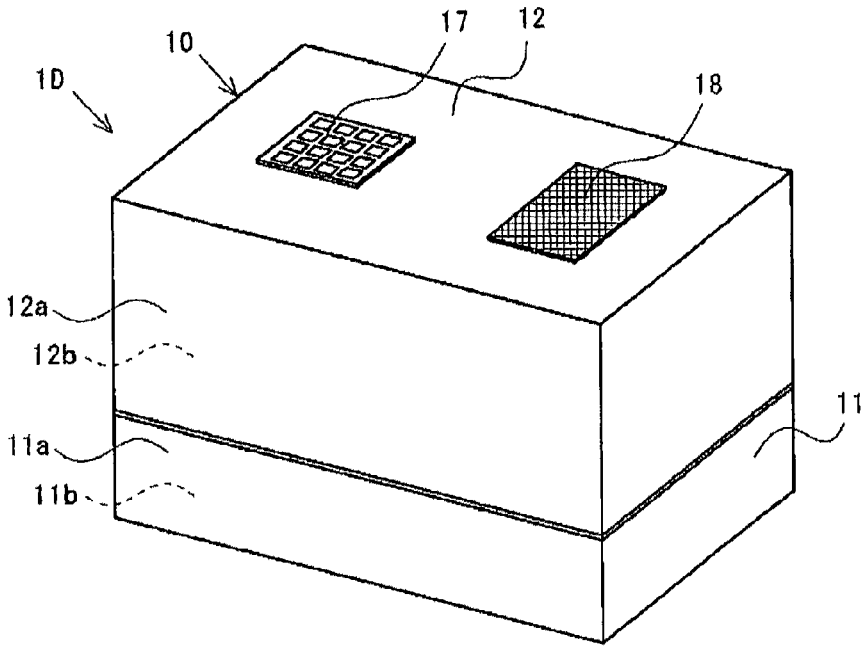
FIG. 4(*a*) illustrates a perspective view of a safety box in a connected condition in accordance with a fourth embodiment of the present invention.
Figure 4B:
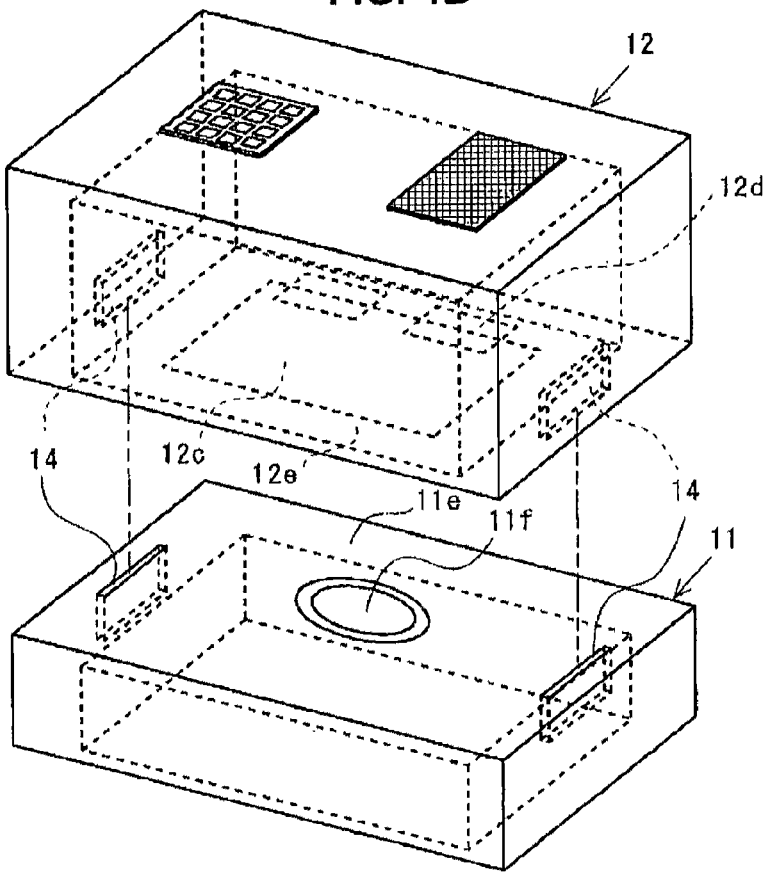

FIG. 4(*a*) illustrates a perspective view of a safety box 1D in a connected condition in accordance with a fourth embodiment and (b) illustrates a perspective view of the safety box in a detached condition. The same reference marks as the embodiment in FIG. 1 are used for the same constituent elements.

As illustrated in FIG. 4(*b*), the weight portion 11 and the storage portion 12 are detachable in the safety box 1D as the safety box 1C in FIG. 3. However, the weight portion 11 and the storing portion 12 are disposed vertically. The storage portion lid 12*c* of storage portion housing 12*a* is provided on the connecting face 12*e* which is the bottom face of storage portion housing 12*a*.

In order to store objects in the storage portion 12, the face of lid 12*c* is placed sideways or face up to open the lid. Tough the storage portion lid 12*c* itself does not have an electric lock for directly locking, a latching means enough to prevent the lid from opening by itself when placed face down is provided.

The inlet-outlet opening 11*f* of weight portion 11 is disposed on the connecting face 11*e* which is the top face of weight portion housing 11*a*, doubling as inlet and outlet.

Each component of electric lock 14 is attached to the connecting face 12*e* which is the bottom face of storage portion housing 12*a* and the connecting face 11*e* which is the top face of weight portion housing 11*a*, respectively. The electric lock 14 in the safety box 1D serves to keep the storage portion housing 12*a* and the weight portion housing 11*a* connected and simultaneously to keep the storage portion lid 12*c* locked.

In the above-described embodiments, it is preferable to hide devices exposed outside such as the controller with a cover or to make the safety box look like a cooler.

The present invention is not limited to the above-described embodiments but includes in its category any safety box using the same principle as the embodiments.

What is claimed is:

1. A safety box comprising:

a main body housing provided with a weight portion and a storage portion, wherein:

the weight portion is provided with a weight portion housing partly forming the main body housing, a weight portion room whose four side faces, top face, and bottom face are framed by the weight portion housing for storing weight substance selected from a group of water, sea water, sand, and/or stone, and openings for the weight substance to be filled in and released from the weight portion room; and the storage portion is provided with a storage portion housing partly forming the main body housing, a storage portion room framed by the main body housing for storing objects, a storage portion lid for closing the storage portion room, an electric lock for keeping the storage portion lid locked, and a controller for controlling locking and unlocking the electric lock in response to input of predetermined information.

2. The safety box according to claim 1, wherein the storage portion housing and the weight portion housing are undetachable and integrally form the main body housing.

3. The safety box according to claim 2, wherein the main body housing is provided with sensors for detecting movement of the main body housing and sonic or visual alarming devices which go off in response to detection by the sensors.

4. The safety box according to claim 3, wherein the main body housing is provided with a transmitter which starts transmission in response to actuation of the alarming devices.

5. The safety box according to claim 2, wherein the main body housing is provided with a motion sensor for detecting a person approaching within a predetermined distance from the main body housing and the sonic or visual alarming devices which go off in response to detection by the motion sensor.

6. The safety box according to claim 5, wherein the main body housing is provided with the transmitter which starts transmission in response to actuation of the alarming devices.

7. The safety box according to claim 2, wherein the controller is capable of wireless communication with remote devices disposed away from the main body housing and sending a signal for notifying the remote devices of actuation of the alarming devices in response to the actuation of the alarming devices.

8. The safety box according to claim 7, wherein the controller is capable of controlling locking and unlocking the electric lock in response to receiving a predetermined signal from the remote devices.

9. The safety box according to claim 1, wherein the storage portion and the weight portion are detachable, the storage portion lid is disposed on a connecting face of the storage portion housing with the storage portion housing and the weight portion housing being connected, and the electric lock keeps the storage portion housing and the weight portion housing connected and simultaneously keeps the storage portion lid locked.

* * * * *